US011242825B2

(12) United States Patent
Morillas Gomez

(10) Patent No.: US 11,242,825 B2
(45) Date of Patent: Feb. 8, 2022

(54) DEVICE FOR REDUCING POLLUTANT GAS EMISSIONS BY MEANS OF CATALYST MANAGEMENT IN THE COMBUSTION PROCESS

(71) Applicants: Ignacio Morillas Gomez, Madrid (ES); ENCOLNVEST INTERNATIONAL, S.L., Madrid (ES)

(72) Inventor: Ignacio Morillas Gomez, Madrid (ES)

(73) Assignees: Ignacio Morillas Gomez, Madrid (ES); ENCOLNVEST INTERNATIONAL, S.L., Madrid (ES)

( * ) Notice: Subject to any disclaimer, the term of this patent is extended or adjusted under 35 U.S.C. 154(b) by 48 days.

(21) Appl. No.: 16/498,668

(22) PCT Filed: Mar. 31, 2017

(86) PCT No.: PCT/ES2017/070196
§ 371 (c)(1),
(2) Date: Sep. 27, 2019

(87) PCT Pub. No.: WO2018/178410
PCT Pub. Date: Oct. 4, 2018

(65) Prior Publication Data

US 2021/0108599 A1 Apr. 15, 2021

(30) Foreign Application Priority Data

Mar. 30, 2017 (ES) ..... 201730376

(51) Int. Cl.
*F02M 27/04* (2006.01)
*F02M 37/22* (2019.01)
*H01F 1/10* (2006.01)

(52) U.S. Cl.
CPC ..... *F02M 27/045* (2013.01); *F02M 37/22* (2013.01); *H01F 1/10* (2013.01); *F23K 2300/101* (2020.05)

(58) Field of Classification Search
CPC ..... F02M 27/045; F02M 37/22; H01F 1/10; F23L 2300/101
See application file for complete search history.

(56) References Cited

U.S. PATENT DOCUMENTS

2002/0108368 A1 8/2002 Hodgson
2008/0310785 A1 12/2008 Niebling et al.
(Continued)

FOREIGN PATENT DOCUMENTS

DE 19938854 C1 1/2001
DE 102005036674 A1 2/2007
(Continued)

*Primary Examiner* — Jacob M Amick
*Assistant Examiner* — Charles J Brauch
(74) *Attorney, Agent, or Firm* — Craft Chu PLLC; Andrew W. Chu

(57) ABSTRACT

The invention relates to a device for reducing pollutant gas emissions by means of catalyst management in the combustion process, characterised in that it comprises: a hollow cylindrical body with a fuel inlet hole in one side of said cylindrical body and a fuel outlet hole in the other side of said cylindrical body; a perforated cylindrical separator inside said body; and a sheet formed by at least one magnetic element and which is situated between the perforated separator and the inner wall of the hollow cylindrical body, such that when the fuel flows inside the device, part of the components of the hydrocarbon magnetise.

8 Claims, 15 Drawing Sheets

(56) References Cited

U.S. PATENT DOCUMENTS

| | | | |
|---|---|---|---|
| 2010/0086446 | A1 | 4/2010 | Matsunaga et al. |
| 2017/0029715 | A1 | 2/2017 | Cingiz |

FOREIGN PATENT DOCUMENTS

| | | | | |
|---|---|---|---|---|
| EP | 2071145 | A1 | 6/2009 | |
| EP | 2705888 | A1 * | 3/2014 | ..... F02M 27/045 |
| EP | 2705888 | A1 | 3/2014 | |
| EP | 3129447 | A1 | 2/2017 | |
| ES | 2080673 | A2 * | 2/1996 | ..... B03C 1/288 |
| ES | 2080673 | A2 | 2/1996 | |
| WO | 03 021102 | A1 | 3/2003 | |
| WO | 2015156745 | A1 | 10/2015 | |

* cited by examiner

DEVICE FOR REDUCING POLLUTANT GAS EMISSIONS BY MEANS OF CATALYST MANAGEMENT IN THE COMBUSTION PROCESS

CROSS-REFERENCE TO RELATED APPLICATIONS

This application is the United States national phase of International Application No. PCT/ES2017/070196 filed Mar. 31, 2017, and claims priority to Japanese Patent Application No. 201730376 filed Mar. 30, 2017, the disclosures of which are hereby incorporated by reference in their entirety.

FIELD OF THE INVENTION

The present invention relates, in general, to a device that makes it possible to reduce pollutant gas emissions by means of catalyst management in the combustion process of motor vehicles by acting on the fuel or hydrocarbon before it enters the engine.

BACKGROUND OF THE INVENTION

Hydrogen is the largest component of hydrocarbons. Hydrogen has a dipole moment, which may be diamagnetic or paramagnetic, that is, with a weak or strong response to magnetic flux. Therefore, it appears in two forms or isomer types, para and ortho, characterised by the rotation of its nuclei.

In the ortho molecule, which occupies odd energy levels, the rotations are parallel with the same orientation for both atoms and, for this reason, it is paramagnetic and a catalyst for many reactions.

The orientation of the rotation has an important effect on physical properties such as specific heat and vapour pressure, as well as behaviour on the gas molecule.

DESCRIPTION OF THE INVENTION

An alternative to the state of the art that solves the shortcomings found therein is required and, contrary to existing solutions, the present invention focuses on a device (100) for reducing pollutant gas emissions by means of catalyst management in the combustion process.

Said device (100) has, among others, thermal conductivity and magnetism properties, and transfers those properties to the fuel molecules with which it is in contact, generating a coercive force which provides a magnetic field with the force necessary to alter these molecules.

These two properties affect the hydrocarbon or fuel molecules, which become the subject of forces under the action of the magnetic field and endure through conduction of that capacity.

This is the key to ensure that the magnetism capacity does not have an instantaneous effect and that it lasts long enough to burn more efficiently.

At the same time, as a result of that conductivity which generates the duration of the effect, and assuming that the fuel is composed of a group of molecules, each of these molecules generates a magnetic field by itself, due to which in that sense, when in contact with the reactive sheet, they change their structure by reacting, trapping the oxygen molecules that are generated and producing a better air and fuel mixture, which translates into a more efficient combustion.

Specifically, the present invention provides for a device (100) for reducing pollutant gas emissions, by means of catalyst management in the combustion process, comprising a hollow cylindrical body with a fuel inlet hole (104) in one side of said cylindrical body and a fuel outlet hole (103) in the other side of said cylindrical body; a perforated cylindrical separator (110) inside said body; and a reactive sheet (120) formed by at least one magnetic element, which is situated between the perforated separator (110) and the inner wall of the hollow cylindrical body, such that when the fuel flows inside the device (100), part of the components of the hydrocarbon magnetise.

BRIEF DESCRIPTION OF THE FIGURES

The above and other advantages and features will be more fully understood from the following detailed description of embodiments, using the following figures as reference, which should be considered in an illustrative and non-limiting manner.

DETAILED DESCRIPTION OF THE INVENTION

Figure 1:
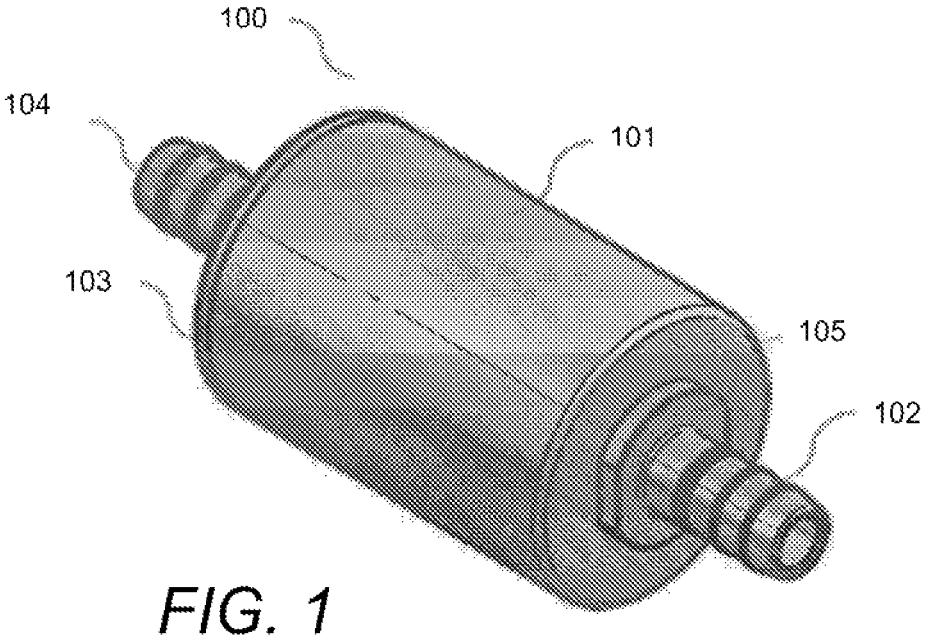
FIG. 1 shows a perspective diagram of an embodiment of the device object of the present invention.
Figure 2:
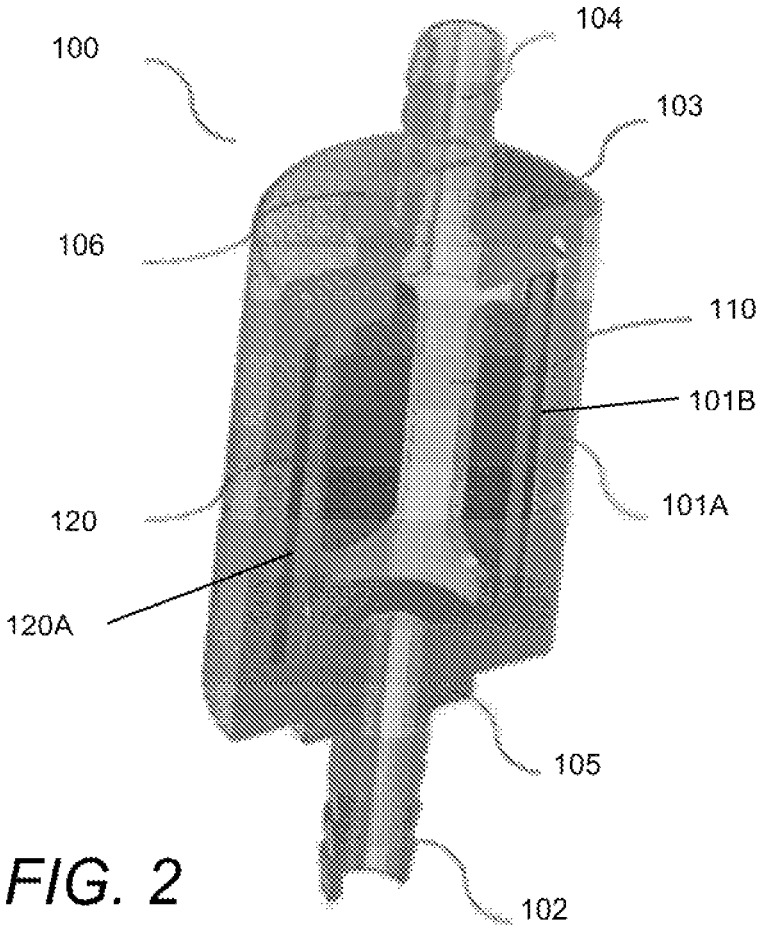
FIG. 2 shows a perspective diagram of a cross section of an embodiment of the device object of the present invention.
Figure 3:
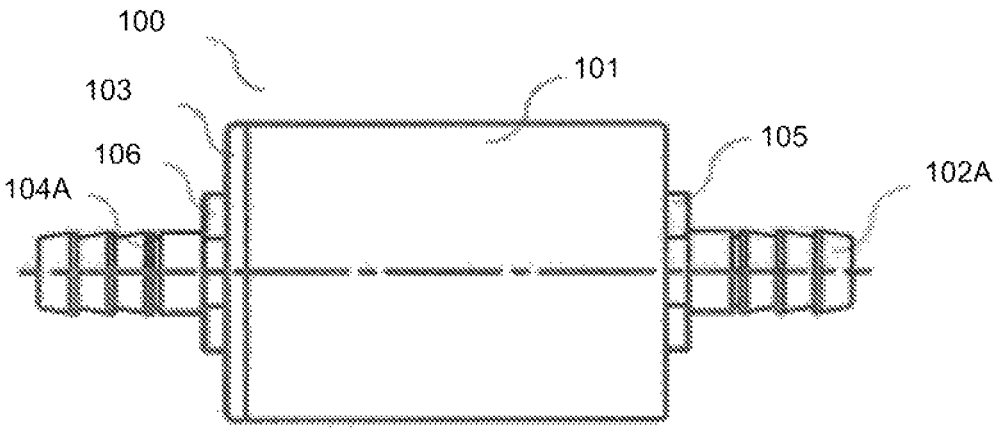
FIG. 3 shows a diagram of a front view of an embodiment of the device object of the present invention.
Figure 4:
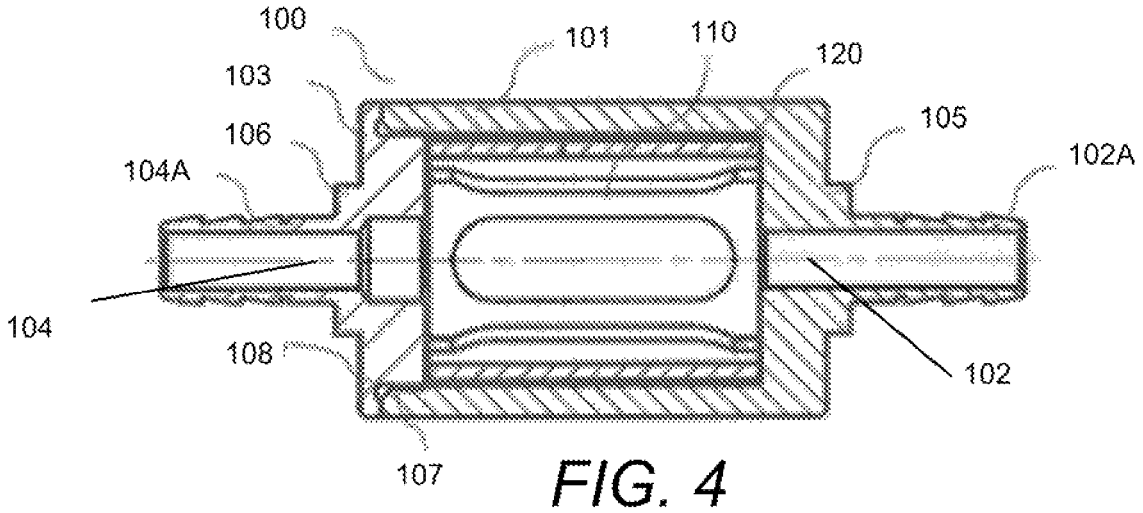
FIG. 4 shows a diagram of a cross section of an embodiment of the device object of the present invention.
Figure 5:
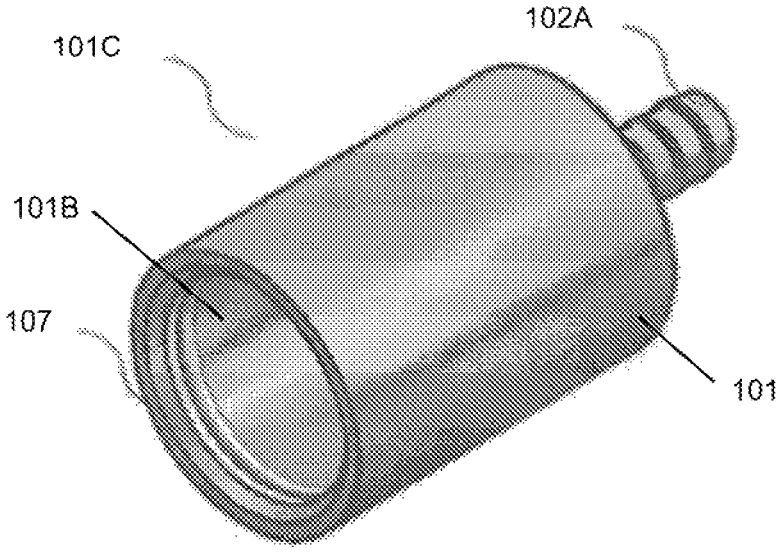
FIG. 5 shows a perspective diagram of an embodiment of the cylindrical body part of the device object of the present invention.
Figure 6:
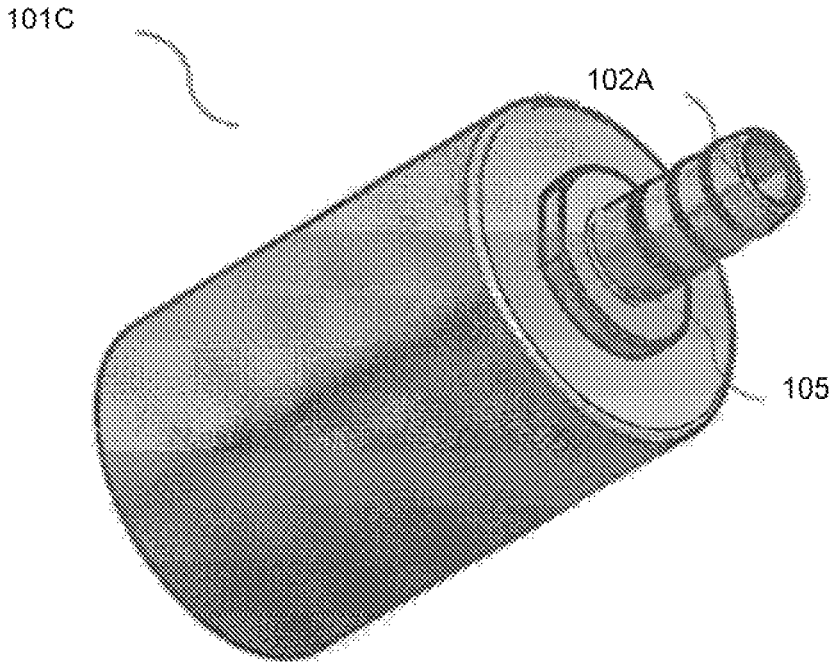
FIG. 6 shows a diagram of another perspective of an embodiment of the cylindrical body part of the device object of the present invention.
Figure 7:
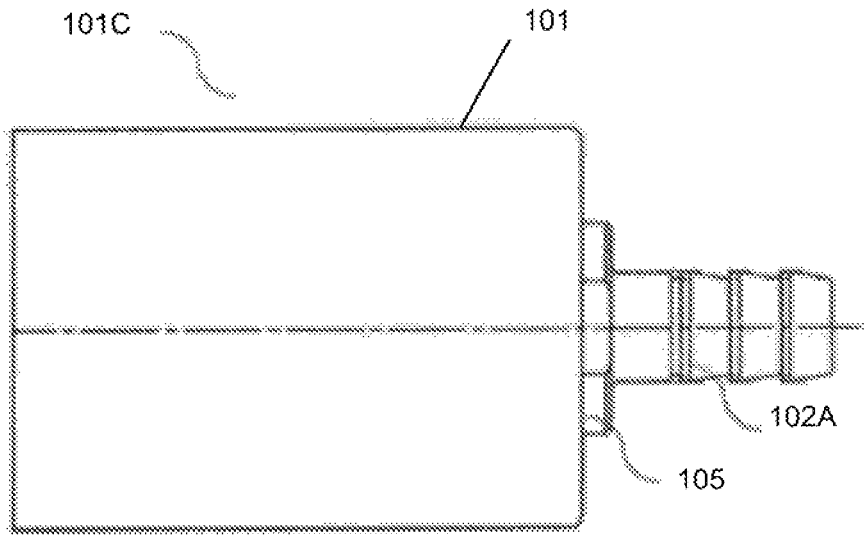
FIG. 7 shows a diagram of a front view of an embodiment of the cylindrical body part of the device object of the present invention.
Figure 8:
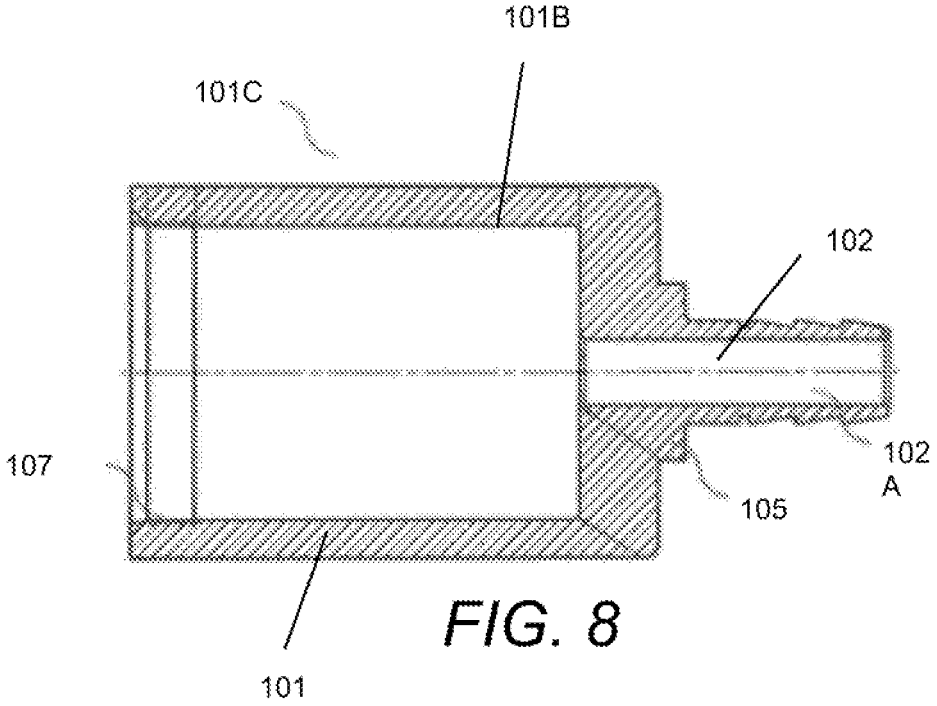
FIG. 8 shows a diagram of a cross section of an embodiment of the cylindrical body part of the device object of the present invention.
Figure 9:
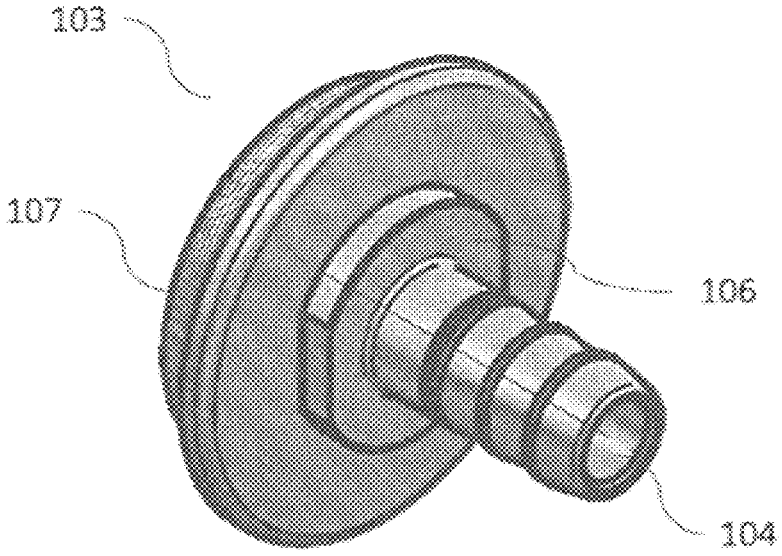
FIG. 9 shows a perspective diagram of an embodiment of the cover part of the device object of the present invention.
Figure 10:
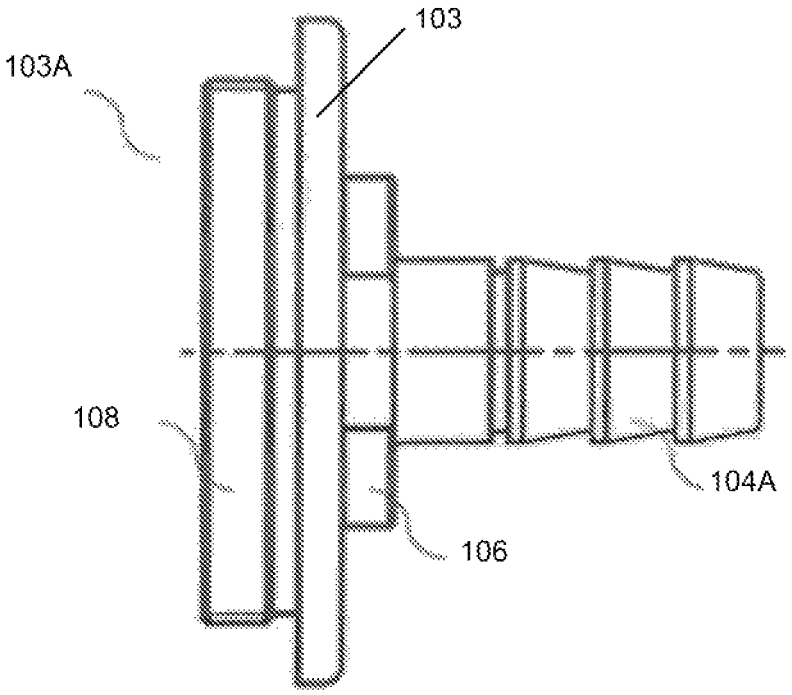
FIG. 10 shows a diagram of a front view of an embodiment of the cover part of the device object of the present invention.
Figure 11:
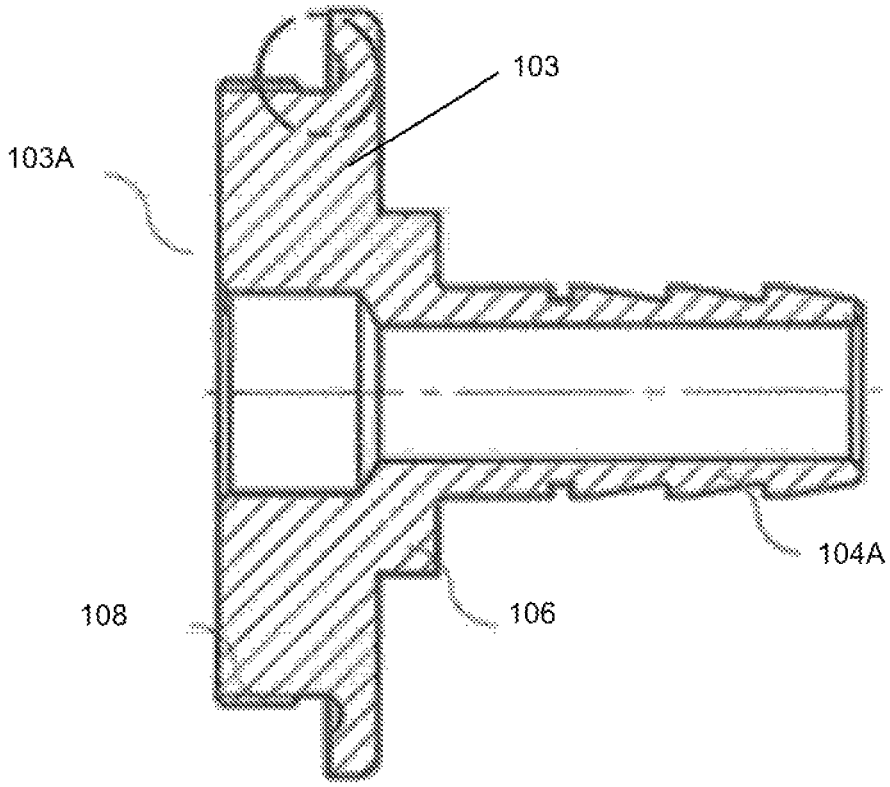
FIG. 11 shows a diagram of a cross section of an embodiment of the cover part of the device object of the present invention.

The device (100) is formed by a cylinder or similar body having a fuel inlet or outlet hole (second fuel hole 104) and another outlet or inlet hole (first fuel hole 102), depending on the function performed by the hole (first fuel hole 102, second fuel hole 104), since the position of the device and the fuel flow does not affect its operation; and inside which is located a perforated separator (110), preferably with a cylindrical shape, with a somewhat smaller diameter than the diameter of the outer cylinder. Between said perforated separator and the inner wall (101B) of the cylindrical device, a reactive sheet (120) with magnetic properties is situated, which incorporates, among other components, barium ferrite, which allows part of the components of the fuel or hydrocarbon to magnetise when the fuel passes through the interior of said device (100).

Said reactive sheet (120) can be provided with a magentic element (120A) as a plasteostruso, i.e., a magnetic rubber obtained by extrusion and, in this particular case of the present invention, it has the characteristic of being multipolar on one of the faces with a high percentage of barium ferrite, which provides a magnetic reference of 2800/3100 Oersted (a field strength range of 246690 to 222816 A/m) for coercive force and 1800/1900 Gauss for induction force (a magnetic flux density range of 143.239 to 151.197 A/m).

In one embodiment, the outer cylinder or hollow cylindrical body 101A is formed by two parts. A first hollow part (101C) with a first cylindrical body (101), having one of the holes (first fuel hole 102), the hydrocarbon or fuel inlet or outlet hole, in one of the bases, in the shape of a pin (first pin 102A) so that the fuel supply pipe can fit into said first pin 102A. The second part or second cover-shaped part 103A is formed by a cover (base 103) that incorporates the second fuel outlet or inlet hole (second fuel hole 104) in its base, depending on the position in which the device (100) is placed, also in the shape of a pin (second pin 104A) to fit the supply tube.

Said cover (103) is arranged to fit in the first part, the cylindrical body (101), by means of a mechanised thread complementary to both parts (threads 107 on the first hollow part 101C and complemetary threads 108 on the second cover-shaped part 103A).

At the base of both fuel inlet and outlet pins (102 and 104) or vice versa, there is a nut-like body (first nut body 105 and second nut body 106) arranged such that the user or assembler of the device (100) can facilitate the installation by holding the device (100) with a wrench or similar when fitting the supply pipe.

Figure 12:
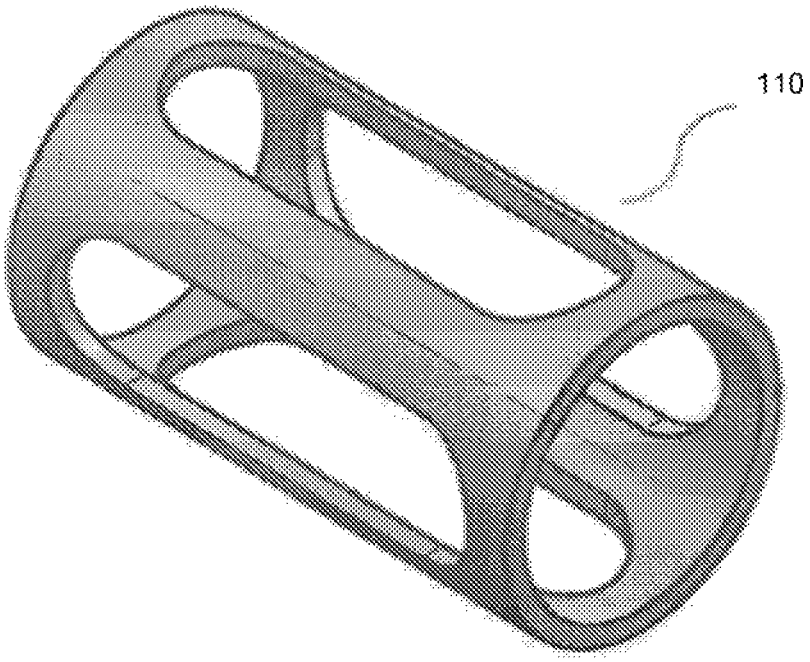
FIG. 12 shows a perspective diagram of an embodiment of the inner cylinder of the device object of the present invention.
Figure 13:
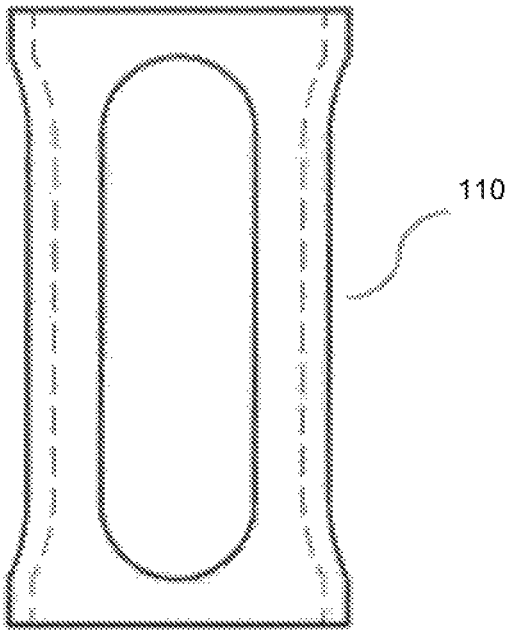
FIG. 13 shows a diagram of a cross section of an embodiment of the inner cylinder of the device object of the present invention.
Figure 14:
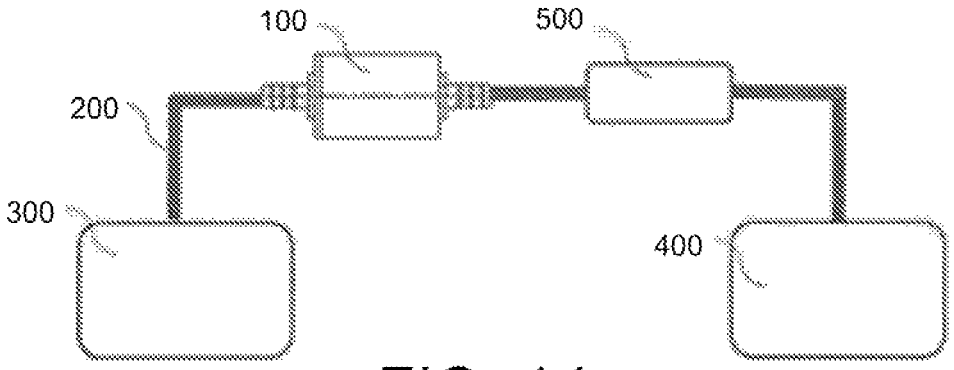
FIG. 14 shows an installation diagram of the installation of the device object of the present invention, placing it between the fuel tank and the gasoline or diesel filter.

The reactive sheet (120) is located between the perforated separator (110) and the inner surface or inner wall 101B of the cylinder (101), so that it is held between both elements, maintaining a maximum contact area with the fuel and without obstructing its passage at any time. This contact with the fuel is favoured by the wide size of the perforations of the separator as shown in FIGS. 12 and 13.

This structure of the device (100) facilitates the manufacturing of the parts and the assembly thereof.

The device (100), when it is in operation and the fuel or hydrocarbon pass through it, causes the hydrogen molecules to change their state from the para state to the more reactive ortho state in order to achieve a better and, thus, a greater mixture of fuel and oxygen can be achieved, which causes the greatest possible optimization of the fuel to be burned making it more efficient, that is, leading to an increase or optimization of the octane or cetane rating.

When the fuel passes through the device (100) under the influence of catalyst substances, the barium ferrite compounds, mainly, provide and improve the combustion process without altering the physical and chemical characteristics of the fuel.

One of the operating principles of the active component of the device (100), that is, of the barium ferrite of the reactive sheet (120), is to increase thermal conductivity, that is to say, the heat flow increases towards the surface of the combustion chamber, altering its speed, at the same temperatures.

The catalyst components are activated during the combustion process, which directly affects combustion and improves the energy and the operational efficiency of the engine (400).

The device (100) has high levels of catalytic activity, selectivity and stability and thus reduces the percentages of pollutant gases in relation to the improvement and optimization of the fuel.

Obviously, the decrease in thermal resistance increases heat flow, and the removal of soot layers from the walls of the combustion chamber eliminates thermal resistance, which also increases the explosion resistance of the fuel.

Cleaning the combustion chamber causes:

the stabilisation of the engine (400) for all loads, a reduction in fuel consumption, an increase in capacity and performance, and an improvement of environmental properties.

When the device (100) is used, in particular, the active barium ferrite component greatly increases all heat transfer coefficients, which leads to a decrease in the thermal resistance of the products of combustion and an improvement of the anti-knock rating of fuel.

Using the device (100) accelerates the oxidation of the fuel, which leads, for example, to a more complete combustion by the diesel engine.

In addition, the duration of combustion is reduced, but the duration of combustion of the fuel load is increased. This means that all the fuel burns more quickly, although the maximum combustion rate decreases.

As a result, the engine (400) starts more "smoothly", which reduces the intensity of the parts of the cylinder-piston group and increases the life of the engine.

In addition, the device (100) stabilises the combustion process itself. The device (100) reduces the load on the catalytic converters and particle filters, since it provides a more complete combustion of the fuel and greatly reduces the amount of harmful substances in the exhaust gases.

The device (100) reduces the exhaust sulphur and nitrogen oxide when the engine (400) is idling, which is especially important for engines in urban vehicles that spend a lot of time idling while stopping at traffic lights and circulating in dense traffic.

The concentration of the active components of the fuel, especially in the diesel engine, is greatly reduced in the presence of the device (100) with the decrease in the temperature in the combustion chamber and the increase in combustion efficiency. Similarly, it explains the reduction of the concentration of nitrogen oxide emissions.

The use of the device (100) with a variety of fuels makes it possible to reduce the requirements of an engine, especially as to the octane rating of the gasoline and the cetane rating of diesel, by cleaning the combustion chamber and controlling combustion.

The device (100) reduces the peak heat release rate in the combustion chamber and the "rigidity" of the engine.

The peak pressure also becomes lower in the presence of an active catalyst component of the device compared to a peak pressure without it. As a result, the engine (400) starts more "smoothly", which reduces the intensity and increases the life of the engine.

The organoelement component of the device (100), the barium ferrite, forms a halo of particles when it decomposes, whose surface oxidises cracking fuel molecules, which leads to an appreciable increase in pressure to the point of separation.

The achievement, therefore, of the catalytic cracking of the fuel molecules resulting in a component with a lower molecular weight and the preignition, slows down the oxidation reaction, which in turn decreases the peak pressure in the combustion chamber, allowing the engine to operate under less harsh conditions.

The post-combustion completion increases in the presence of the device (100) which involves removing excessive soot and minerals to clean the walls of the combustion chamber.

The use of the device (100) stabilises combustion. The stabilisation of temperature fluctuations in the combustion chamber, the burning process of the air-fuel mixture and the reduction of the local peak temperature reduce the formation of nitrogen oxides. That "detergency" of the device (100) contributes to a more complete chemical conversion of carbon, resulting in the reduction of soot emissions in a spectacular manner.

The device (100) significantly reduces the amount of harmful impurities in combustion processes, which positively affects the environment, and which is especially important for large cities and highly polluted cities.

Since it is located only in the section of the intake or supply pipe, due to its physical condition it prevents the device (100) from interfering in any mechanical part of the engine or the vehicle in the route from the tank (300) to the engine (400).

Figure 15:
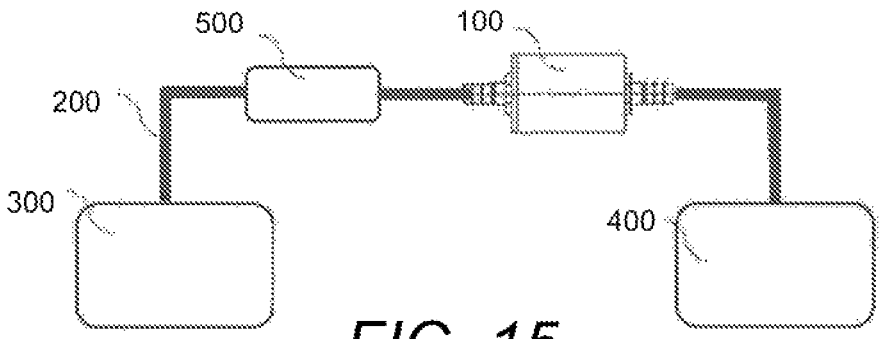
FIG. 15 shows an installation diagram of the installation of the device object of the present invention, placing it between the gasoline or diesel filter and the engine.

In this sense, the device (100) can be placed in the fuel supply pipe, between the fuel tank (300) and the engine (400), whether there is a gasoline or diesel filter (500) on either side of said device (100), as shown in FIGS. 15 and 16 respectively. The result is that the combination of fuel with oxygen is dramatically improved, achieving a better mixture and more regular and continuous combustion.

The device (100) can be manufactured with a size such that the reactive sheet (120) can act on a certain fuel flow and, on the other hand, the device (100) does not exhibit sizing problems so as it to be installed inside the vehicle. However, if the device (100) is to be used for a larger flow than the one initially intended, several of these devices (100) can be incorporated in a series, that is to say, one behind the other, along the supply tube.

The invention claimed is:

1. A device for reducing pollutant gas emissions, comprising:

a hollow cylindrical body being comprised of an inner wall defining a body axis and having one end with a first fuel hole axially aligned with said body axis and an opposite end with a second fuel hole axially aligned with said first fuel hole and said body axis;

a perforated cylindrical separator inside said hollow cylindrical body, and a reactive sheet being comprised of at least one magnetic element and being situated between the perforated separator and the inner wall of said hollow cylindrical body, wherein said perforated cylindrical separator holds said reactive sheet adjacent the inner wall so as to allow fuel flow along said reactive sheet and said perforated cylindrical sperator from end to opposite end and so as to prevent fuel flow through said reactive sheet toward the inner wall and between said inner wall and said reactive sheet.

2. The device for reducing pollutant gas emissions, according to claim 1, wherein said at least one magnetic element is comprised of barium ferrite.

3. The device for reducing pollutant gas emissions, according to claim 1, wherein said reactive sheet is further comprised of plasteostruso, having a multipolar face, and wherein said at least one magnetic element is comprised of barium ferrite, said reactive sheet having a magnetic a field strength range of 246690 to 222816 A/m and a magnetic flux density range of 143.239 to 151.197 A/m.

4. The device for reducing pollutant gas emissions, according to claim 1, wherein said hollow cylindrical body is further comprised of:

a first hollow part being comprised of a first cylindrical body so as to form said inner wall and said one end with said first fuel hole, and a second cover-shaped part being comprised of a base so as to form said opposite end with said second fuel hole, wherein said second cover-shaped part is removably fit into said first hollow part so as to form said hollow cylindrical body.

5. The device for reducing pollutant gas emissions, according to claim 4, wherein said first cylindrical body is comprised of threads, wherein said base is comprised of complementary threads, and wherein said first hollow part and said second cover-shaped part are in removable threaded engagement so as to form said hollow cylindrical body.

6. The device for reducing pollutant gas emissions, according to claim 1, wherein said first fuel hole is comprised of a first pin so as to fit a fuel supply tube, and wherein said second fuel hole is comprised of a second pin so as to fit said fuel supply tube.

7. The device for reducing pollutant gas emissions, according to claim 1, further comprising: a first nut body around said first fuel hole; and a second nut body around said second fuel hole.

8. A system for reducing pollutant gas emissions, comprising:

a device, according to claim 1;

a fuel supply tube connected to said device;

a fuel tank connnected to said fuel supply tube; and an engine of a vehicle connected to said fuel supply tube, wherein said device is arranged between said fuel tank and said engine.

* * * * *